US008647214B2

(12) United States Patent
Wiegers

(10) Patent No.: US 8,647,214 B2
(45) Date of Patent: Feb. 11, 2014

(54) METHODS AND DEVICES FOR ANALYZING GOLF SWINGS

(75) Inventor: Michael R. Wiegers, Baldwin City, KS (US)

(73) Assignee: Garmin Switzerland GmbH (CH)

( * ) Notice: Subject to any disclaimer, the term of this patent is extended or adjusted under 35 U.S.C. 154(b) by 1261 days.

(21) Appl. No.: 12/129,428

(22) Filed: May 29, 2008

(65) Prior Publication Data

US 2009/0298605 A1 Dec. 3, 2009

(51) Int. Cl.
*A63F 13/00* (2006.01)

(52) U.S. Cl.
USPC ..... 473/199; 473/219; 473/222; 473/223; 473/407

(58) Field of Classification Search
USPC ..... 473/199
See application file for complete search history.

(56) References Cited

U.S. PATENT DOCUMENTS

| | | | | |
|---|---|---|---|---|
| 6,285,445 | B1 * | 9/2001 | Winfield et al. | 356/28 |
| 6,375,579 | B1 | 4/2002 | Hart | 473/131 |
| 2005/0054457 | A1 * | 3/2005 | Eyestone et al. | 473/221 |
| 2007/0010341 | A1 | 1/2007 | Miettinen et al. | 473/131 |
| 2007/0135237 | A1 | 6/2007 | Reeves | 473/407 |
| 2007/0298896 | A1 * | 12/2007 | Nusbaum et al. | 473/131 |
| 2007/0298898 | A1 * | 12/2007 | Kiraly | 473/131 |
| 2008/0039222 | A1 * | 2/2008 | Kiraly | 473/131 |
| 2008/0182685 | A1 * | 7/2008 | Marty et al. | 473/407 |
| 2010/0201512 | A1 * | 8/2010 | Stirling et al. | 340/539.11 |

OTHER PUBLICATIONS

Suunto G6 User's Guide, Suunto Oy, Jul. 2005.
GolfLogix User Guide, GolfLogix, Inc., published prior to May 29, 2008.

* cited by examiner

*Primary Examiner* — Dmitry Suhol
*Assistant Examiner* — Ankit Doshi
(74) *Attorney, Agent, or Firm* — Samuel M. Korte; Mohammad M. Ali

(57) ABSTRACT

A method and electronic device for analyzing golf swings associates actual ball flight data with sensed swing characteristics. The electronic device includes a location-determining component; a sensor; a display; and a computing device all housed within a portable, handheld or wearable enclosure. The computing device may associate the ball flight data with the swing characteristic data by storing the data together in memory, linking the data in memory, displaying representations of the data together, or by any other method. The computing device may also create a reference profile for a golfer based on ball flight data and sensed swing characteristics for a plurality of golf swings and may associate swing characteristics with particular golf clubs.

23 Claims, 11 Drawing Sheets

– 700 –

| 702 SHOT | 704 SWING CHARACTERISTIC | 706 BALL FLIGHT |
|---|---|---|
| 1 | OPEN CLUBFACE | 210 YDS, 10° RIGHT |
| 2 | CLOSED CLUBFACE | 160 YDS, 30° RIGHT |
| 3 | POOR TEMPO | 95 YDS, STRAIGHT |
| 4 | NO FOLLOW-THROUGH | 8 YDS |
| . | | |
| . | | |
| . | | |
| . | | |
| . | | |
| 10 | | |

Fig. 7.

– 800 –

JOHN DOE
MARCH 22, 2008

802 804 806 808

| SHOT | CLUB | SWING CHARACTERISTIC | RESULT |
|---|---|---|---|
| 1 | DRIVER | OPEN CLUBFACE | SLICE |
| 2 | 7 - WOOD | CLOSED CLUBFACE | HOOK |
| 3 | PW | POOR TEMPO | SHORT |
| 4 | PUTTER | NO FOLLOW - THROUGH | SHORT |
| 5 | | . | . |
| 6 | | . | . |
| . | | . | . |
| . | | . | . |
| . | | . | . |
| 94 | | . | . |

Fig. 8.

– 900 –

USER PROFILE - JOHN DOE (910)

MARCH 23, 2008 (912)

| SWING CHARACTERISTIC (902) | FREQUENCY (906) | RESULT (908) |
|---|---|---|
| OPEN CLUBFACE | 14 | 10 SLICES ; 2 HOOKS |
| CLOSED CLUBFACE | 6 | 4 HOOKS |
| OVER - THE - TOP | 3 | 3 SLICES |
| INCOMPLETE SHOULDER ROTATION | 5 | 3 SHORT |

*Fig. 9.*

– 1000 –

1010

USER PROFILE - JOHN DOE

1012

JAN. 1, 2007 - MAY 30, 2008

1002 1004 1006 1008

| CLUB | FREQUENCY | AVG. DISTANCE | AVG. LANDING |
|---|---|---|---|
| DRIVER | 872 | 242 YDS | 27 YDS RIGHT |
| 5 - WOOD | 405 | 207 YDS | 15 YDS RIGHT |
| 3 - IRON | 212 | 196 YDS | 13 YDS RIGHT |
| 4 - IRON | 196 | 188 YDS | 12 YDS RIGHT |
| 5 - IRON | 232 | 178 YDS | 6 YDS RIGHT |
| 6 - IRON | 312 | 167 YDS | 2 YDS LEFT |
| 7 - IRON | 345 | 156 YDS | 4 YDS LEFT |
| 8 - IRON | 198 | 145 YDS | 5 YDS LEFT |
| 9 - IRON | 72 | 129 YDS | 5 YDS LEFT |
| PW | 512 | 99 YDS | 6 YDS LEFT |
| LW | 104 | 72 YDS | 6 YDS LEFT |

Fig. 10.

METHODS AND DEVICES FOR ANALYZING GOLF SWINGS

BACKGROUND

Embodiments of the present invention relate to golf swing analysis methods and devices. More particularly, embodiments of the invention relate to methods and devices that associate actual golf ball flight data with sensed swing characteristic data.

Golf is one of the most difficult sports to learn because relatively minor golf swing errors can result in exaggerated mis-hits. For example, a relatively minor mis-positioning of a golf club head face (e.g. closed club face or open club face) may result in a severe slice (ball curves right) or hook (ball curves left).

Because most golf swing errors are difficult to detect by the naked eye, a great variety of automated swing analysis systems have been developed. Some of these systems detect golf swing characteristics with video equipment, lasers, acceleration sensors, or other technologies and then attempt to predict a golf ball's trajectory or resting place based on the sensed swing characteristics. For example, a swing analysis system may sense an open club face and then display or otherwise indicate a slice, because an open club face often results in a slice. Unfortunately, such predictions are often inaccurate because the same swing characteristic, when slightly changed, may result in different ball flight trajectories and distances. Moreover, many golfers have multiple swing flaws that, when combined, result in difficult to predict results. For example, many novice golfers simultaneously swing "over-the-top" (downswing starts outside ball and ends inside ball) and close their club face. The first error often results in a slice, whereas the second often results in a hook or pull-hook. Combined, the two errors can result in any of these mis-hits or even a relatively straight (although weak) shot. Therefore, existing swing analysis systems often fail to accurately predict the actual trajectory or resting place of golf balls.

SUMMARY

Embodiments of the present invention provide a distinct advance in the art of golf swing analysis methods and devices by providing a method and device that associates actual ball flight data with sensed swing characteristic data. Embodiments of the invention may be implemented with an electronic device that includes a location-determining component; a sensor; a display; and a computing device all housed within a portable, handheld or wearable enclosure. The electronic device and its components illustrated and described herein are merely examples of a device and components that may be used to implement embodiments of the invention and may be replaced with other devices and components without departing from the scope of the claims.

The location determining component is used to determine an approximate start position of a golf ball and an approximate rest position of the golf ball after it has been struck. In one embodiment, the location-determining component is a satellite navigation receiver that receives satellite signals from a plurality of satellites and determines location information as a function of the satellite signals. In other embodiments, the location determining component may receive location information from other external devices such as a separate satellite navigation receiver.

The sensor senses at least one swing characteristic of the golfer or the golfer's golf club as the golfer strikes the golf ball. For example, the sensor may sense a club head loft angle, a club head face angle, a club head velocity, a club swing path, a club swing plane, the golfer's stance, the golfer's head position, swing timing, the golfer's backswing, the golfer's impact position, the golfer's follow-through, the golfer's shoulder rotation, the golfer's wrist angle, or any other aspect of a golf swing.

In some embodiments, the sensor may be configured to be placed on the ground near a golf ball to be struck so as to sense a movement, speed, or position of a golf club as it strikes the ball. For example, the sensor may be a position or motion type sensor including a radiation source for providing a plane of radiation through which a golf club can pass, a radiation sensor or reflector carried by the golf club, a timing circuit operable for determining a time period between passage of portions of the golf club head through the radiation plane, and a processing system for processing the time period and calculating a characteristic value for club head movement through a ball impact zone. The sensed club head characteristic may be, for example, the club's loft angle, face angle, velocity, path or other measurable characteristic.

In other embodiments, the sensor may be configured to be worn or carried by the golfer to sense a swing characteristic based on the golfer's movements. For example, the sensor may be an inertial type sensor including one or more accelerometers and a processing system. The accelerometers measure accelerations of the golfer's arm or other body part, and the processing system estimates a motion parameter utilizing the acceleration measurements. The motion parameter may be, for example, a duration of the golfer's backswing, downswing, or follow-through or a speed or tempo of the golfer's swing or portion of a swing.

In still other embodiments, both a motion-type sensor and an inertial-type sensor may be used to sense the same swing characteristics or may be used to sense different but related swing characteristics. The sensor or sensors described herein for sensing swing characteristics may be replaced with other known golf swing sensors.

The computing device is coupled with the location-determining component and the sensor for calculating ball flight data and associating it with data for the sensed swing characteristics. The ball flight data may be calculated based on the approximate start position and the approximate rest position of the golf ball and may include, for example, a driving distance or other distance of the golf ball; an angle between the approximate start position and approximate rest position of the golf ball; a distance between the approximate rest position of the golf ball and a fairway; a distance between the approximate rest position of the golf ball and a green; a distance between the approximate rest position of the golf ball and a portion of a green; a distance between the approximate rest position of the golf ball and a flagstick; or a distance between the approximate rest position of the golf ball and a hazard.

The computing device may associate the ball flight data with the swing characteristic data by storing the data together in memory, linking the data in memory, displaying representations of the data together, or by any other method. In some embodiments, the computing device may also associate the ball flight data and swing characteristic data by creating a reference profile for a golfer based on the ball flight data and the swing characteristic data for a plurality of golf swings. The computing device may also associate ball flight data and/or swing characteristic data with particular golf clubs.

The housing may be sized and configured so it can be laid on the ground in the vicinity of a golf ball to be struck to sense a swing characteristic. In other embodiments, the housing is wearable, much like a watch, to sense a swing characteristic based on a user's arm or other body movements while swinging. In yet other embodiments, the electronic device may consist of both a handheld device and a wearable device that each perform some of the functions described herein.

These and other aspects of the present invention are described more fully in the detailed description below.

BRIEF DESCRIPTION OF THE DRAWING FIGURES

Embodiments of the present invention are described in detail below with reference to the attached drawing figures, wherein:

FIG. 7 is a sample screen display of the electronic device of FIG. 1 or FIG. 3 or of an external computing device;

FIG. 8 is another sample screen display of the electronic device of FIG. 1 or FIG. 2 or of an external computing device;

FIG. 9 is another sample screen display of the electronic device of FIG. 1 or FIG. 2 or of an external computing device;

FIG. 10 is another sample screen display of the electronic device of FIG. 1 or FIG. 2 or of an external computing device;

Figure 2:
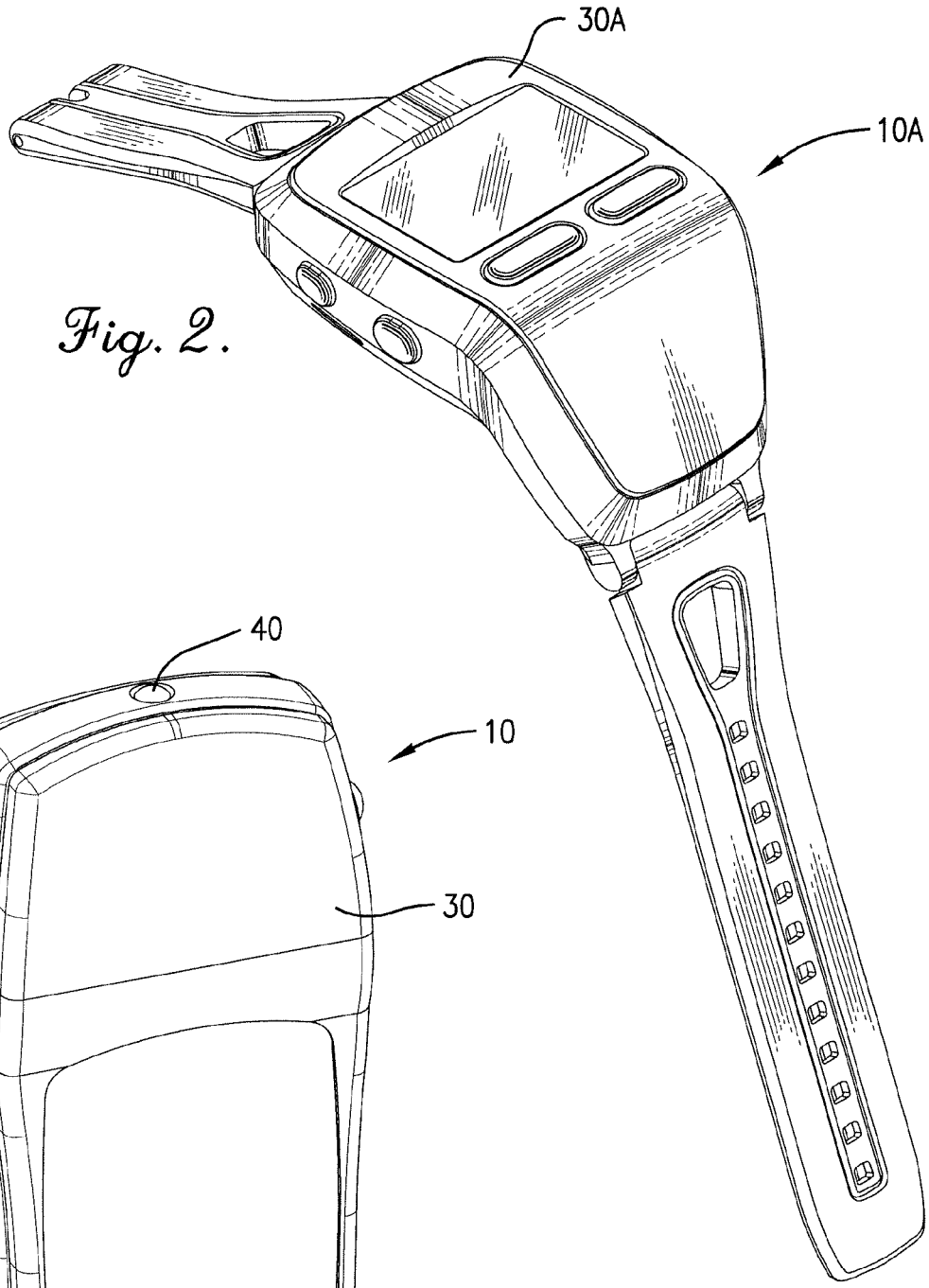
FIG. 2 is an isometric view of an electronic device constructed in accordance with another exemplary embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawing figures that illustrate specific embodiments in which the present invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense.

Figure 1:
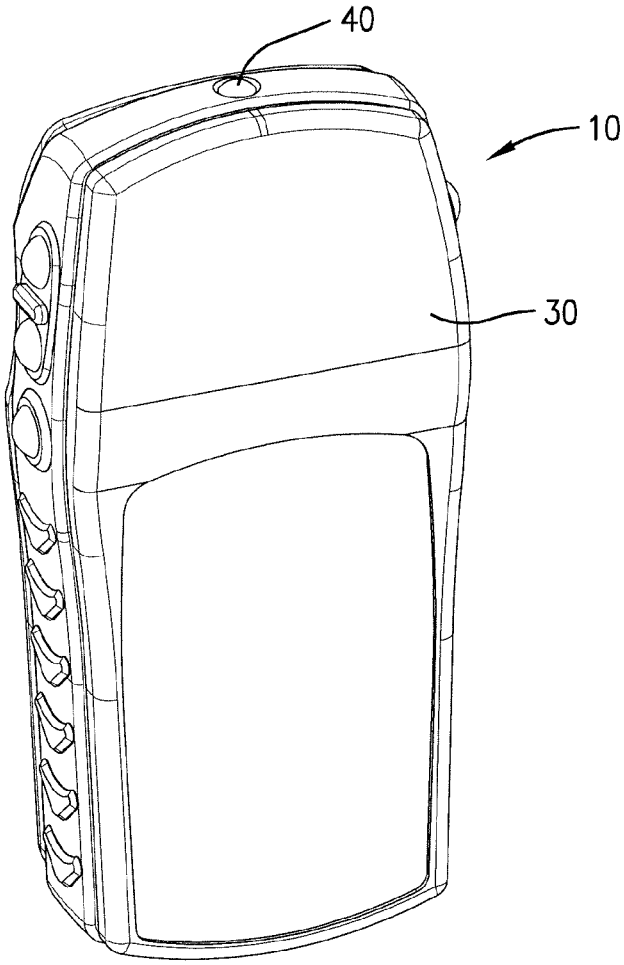
FIG. 1 is an isometric view of an electronic device that may be used to implement exemplary embodiments of the present invention.
Figure 4:
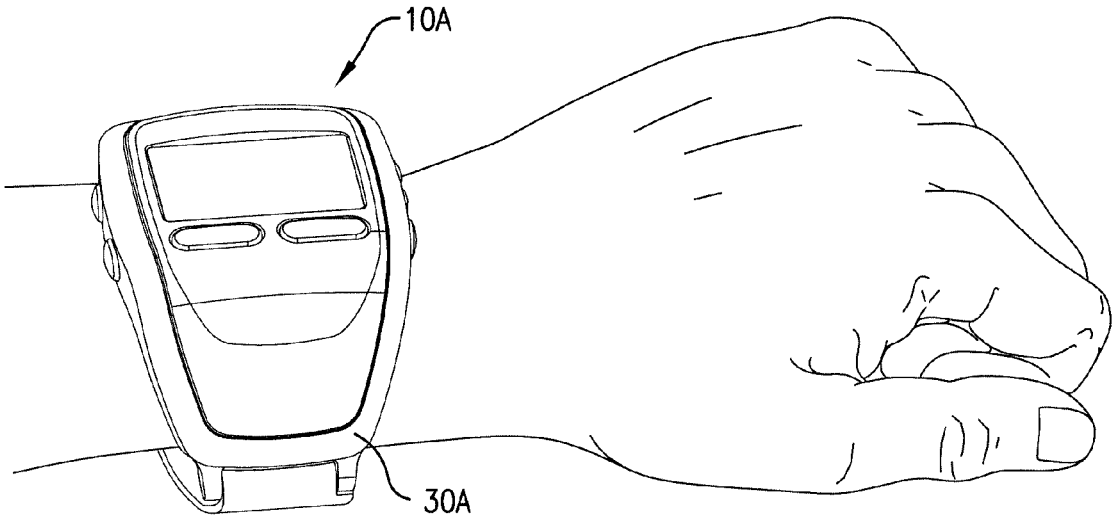
FIG. 4 is an isometric view of a golfer wearing and using the device of FIG. 3 in accordance with certain aspects of the invention.

Embodiments of the present invention can be implemented in hardware, software, firmware, or a combination thereof. In one embodiment, the invention is implemented with an electronic device 10, an example of which is illustrated in FIG. 1. Another exemplary electronic device 10A is illustrated in FIGS. 2 and 4 and discussed in more detail below. The electronic devices 10 or 10A may be stand-alone devices or may be incorporated with other types of devices such as a navigation-enabled mobile phone, personal digital assistant, satellite navigation receiver, or any other electronic device. The embodiments of the electronic devices 10, 10A and their components illustrated and described herein are merely examples of devices and components that may be used to implement the present invention and may be replaced with other devices and components without departing from the scope of the present invention.

Figure 5:
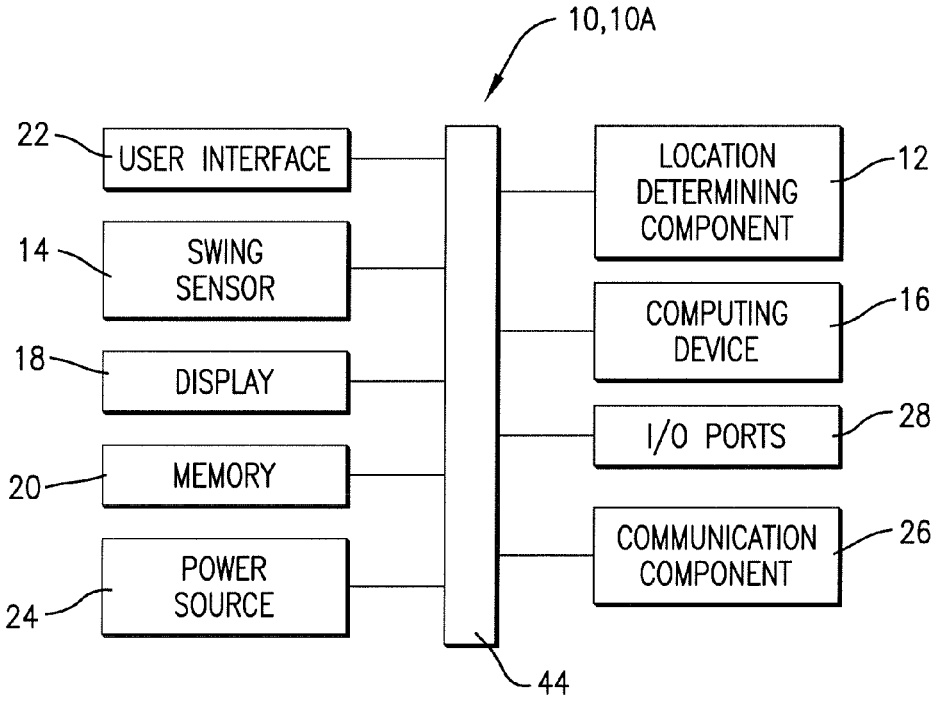
FIG. 5 is a block diagram illustrating certain components of the devices of FIGS. 1 and 2.

An exemplary embodiment of the electronic device 10 is illustrated in FIG. 5 and includes a location-determining component 12, a swing sensor 14, a computing device 16, and a display 18. The electronic device 10 may also include memory 20, a user interface 22, a power source 24, a communications component 26, one or more I/O ports 28, and a housing 30, 30A for housing the various components of the device 10. As described in more detail below, the alternative embodiment of the electronic device 10A includes the same or similar components.

The location determining component 12 determines locations of the device 10 as it is carried or otherwise moved from place to place and generates and sends corresponding location data to the computing device 16 so that it may be linked or otherwise associated with sensed swing characteristic data as described in more detail below. In some embodiments, the location determining component 12 determines an approximate start position of a golf ball before, or generally concurrently with, the striking of the golf ball and an approximate landing or rest position of the golf ball after it has been struck.

Figure 6:
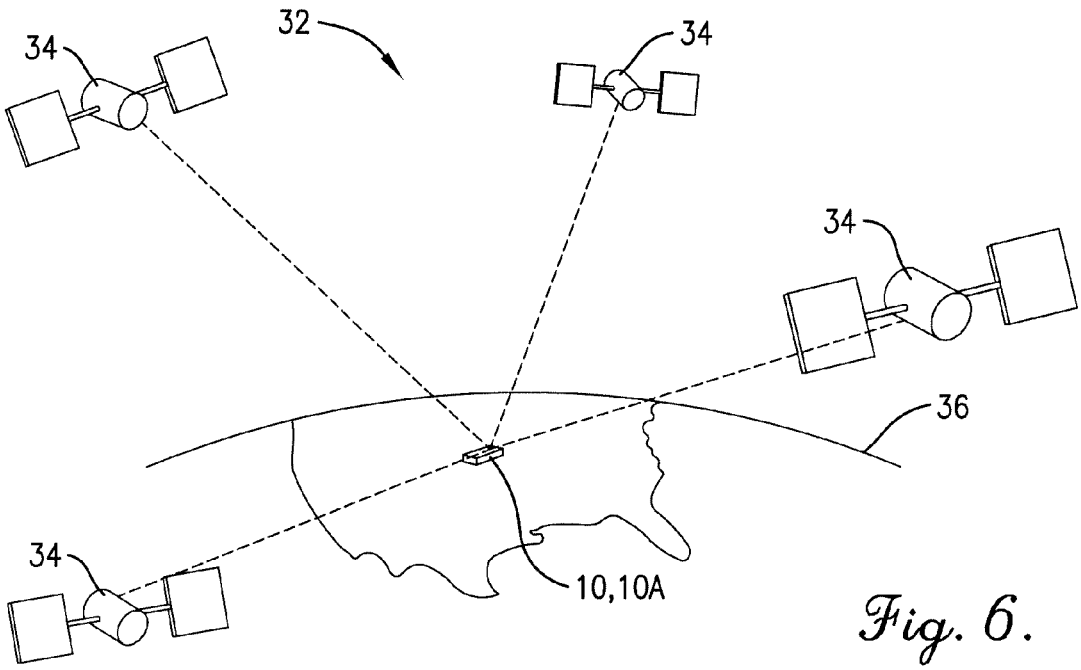
FIG. 6 is a schematic diagram of a Global Navigation Satellite System (GNSS) that may be used to send navigation signals to the electronic device of FIG. 1 and/or FIG. 2.

The location determining component 12 may be a satellite navigation receiver that works with a global navigation satellite system (GNSS) such as the global positioning system (GPS) primarily used in the United States, the GLONASS system primarily used in the Soviet Union, or the Galileo system primarily used in Europe. FIG. 6 shows a representative view of a GNSS denoted generally by reference numeral 32. A plurality of satellites 34 are in orbit about the Earth 36. The orbit of each satellite is not necessarily synchronous with the orbits of other satellites and, in fact, is likely asynchronous. A satellite navigation receiver device such as the electronic device 10 or 10A is shown receiving spread spectrum satellite signals from the various satellites 36.

The spread spectrum signals continuously transmitted from each satellite 34 utilize a highly accurate frequency standard accomplished with an extremely accurate atomic clock. Each satellite 34, as part of its data signal transmission, transmits a data stream indicative of that particular satellite. The device 10 or 10A must acquire spread spectrum satellite signals from at least three satellites for the receiver device to calculate its two-dimensional position by triangulation. Acquisition of an additional signal, resulting in signals from a total of four satellites, permits the device 10 or 10A to calculate its three-dimensional position.

The location determining component 12 and the computing device 16 are operable to receive navigational signals from the satellites 34 and to calculate positions of the device 10 as a function of the signals. The location determining component 12 and computing device 16 may also determine track logs or any other series of geographic coordinates corresponding to points along a golf course or other path traveled by a user of the device 10. The location determining component 12 and/or the computing device 16 may also be operable to calculate routes to desired locations, provide instructions to navigate to the desired locations, display maps and other information on the display screen 18, and to execute other functions described herein.

The location determining component 12 may include an antenna to assist in receiving the satellite signals. The antenna may be a patch antenna, a linear antenna, or any other type of antenna that can be used with navigational devices. The antenna may be mounted directly on or in the housing 30 or 30A or may be mounted external to the housing.

The location determining component 12 may include one or more processors, controllers, or other computing devices and memory so that it may calculate location and other geographic information without the computing device 16 or it may utilize the components of the computing device 16. Further, the location determining component 12 may be integral with the computing device 16 such that the location determining component 12 may be operable to specifically perform the various functions described herein. Thus, the computing device 16 and location determining component 12 can be combined or be separate or otherwise discrete elements.

Although embodiments of the electronic device 10 or 10A may include a satellite navigation receiver, it will be appreciated that other location-determining technology may be used. For example, the communication component 26 may be used to determine the location of the device 10 or 10A by receiving data from at least three transmitting locations and then performing basic triangulation calculations to determine the relative position of the device with respect to the transmitting locations. For example, cellular towers or any customized transmitting radio frequency towers can be used instead of satellites. With such a configuration, any standard geometric triangulation algorithm can be used to determine the location of the electronic device.

In other embodiments, the location determining component 12 need not directly determine the current geographic location of the device 10 or 10A. For instance, the location determining component 12 may determine the current geographic location through a communications network, such as by using Assisted GPS (A-GPS), or from another electronic device. The location determining component may even receive location data directly from a user. For example, a user may obtain location data for a golf ball before and after it has been struck from another satellite navigation receiver or from another source and then manually input the data into the device 10.

The electronic device 10 or 10A may also include or be coupled with a pedometer, accelerometer, compass, or other dead-reckoning components which allow it to determine the device's location, and hence the position or location of a golf ball when the location determining component 12 cannot receive satellite or other signals.

The sensor 14 senses at least one swing characteristic of the golfer or the golfer's golf club as the golfer strikes the golf ball. For example, the sensor 14 may sense a club head loft angle, a club head face angle, a club head velocity, a club swing path, a club swing plane, the golfer's stance, the golfer's head position, the golfer's backswing, the golfer's impact position, the golfer's follow-through, the golfer's shoulder rotation, the golfer's wrist angle, or any other aspect of a golf swing.

In the embodiment of the device 10 shown in FIGS. 1 and 2, the sensor 14 may be a position or motion type sensor configured to sense a position or orientation of a golf club head 38 before, during, or after it strikes a golf ball 39. The sensor 14 may include a radiation source 40 for providing a plane of radiation through which the golf club can pass, at least one radiation sensor 42 carried by the golf club, a timing circuit operable for determining a time period between passage of portions of the golf club head through the radiation plane, and a processing system for processing the time period and calculating a characteristic value for club head movement through a ball impact zone. The sensed club head characteristic may be, for example, the club's loft angle, face angle, velocity, path or other measurable characteristic.

The radiation source 40 may be positioned on one end of the housing 30 as illustrated in FIG. 2 so the electronic device 10 may be placed on the ground between the golfer and the golf ball 39 with the laser beams directed toward the golf ball 39. During a swing, the golf club 38 moves through the various planes of laser beams and the beams are detected by the sensor 42. Data is then transmitted from the sensor 42 carried on the golf club to the electronic device, which calculates the club head position, orientation and velocity relative to the golf ball at the point of impact with the golf ball. The radiation sensor 42 may also be a reflective type sensor that reflects the radiation from the radiation source 40 back to a detector or other sensor.

FIGS. 2 and 4 illustrate an electronic device 10A constructed in accordance with another embodiment of the invention. The electronic device 10A has many or all of the same components as the device 10, but includes a housing 30A configured to be worn or carried by the golfer to sense a swing characteristic based on the golfer's movements. For this embodiment, the sensor 14 may be an inertial sensor including one or more accelerometers and a processing system. The accelerometers measure accelerations of the golfer's arm or other body part, and the processing system estimates a motion parameter utilizing the acceleration measurements. The motion parameter may be, for example, a duration of the golfer's backswing, downswing, or follow-through or a speed or tempo of the golfer's swing or portion of a swing. An inertial sensor that may be used with embodiments of the present invention is discussed in more detail in published U.S. Patent Application No. 2007/0208544, which is hereby incorporated by reference in its entirety. In other embodiments, both an inertial-type sensor and a motion-type sensor may be used to sense the same swing characteristics or different but related swing characteristics. Other types of sensors and methods may be used to sense swing characteristics. The other components described herein with respect to the electronic device 10 are also contained in the electronic device 10A.

The computing device 16 may include any number of processors, controllers, integrated circuits, programmable logic devices, or other computing devices and resident or external memory for storing data and other information accessed and/or generated by the device 10 or 10A. The computing device 16 is preferably coupled with the location determining component 12, the swing sensor 14, the display 18, the memory 20, the user interface 22, the communications component 26, and other components through wired or wireless connections, such as a data bus 44, to enable information to be exchanged between the various components.

The computing device 16 may implement a computer program and/or code segments to perform some the functions described herein. The computer program may comprise an ordered listing of executable instructions for implementing logical functions in the computing device. The computer program can be embodied in any computer-readable medium for use by or in connection with an instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electromagnetic, infrared, or semi-conductor system, apparatus, device, or propagation medium. More specific, although not inclusive, examples of the computer-readable medium would include the following: an electrical connection having one or more wires, a random access memory (RAM), a read-only memory (ROM), an erasable, programmable, read-only memory (EPROM or Flash memory), a portable computer diskette, and a portable compact disk read-only memory (CDROM).

The display 18 is coupled with the computing device 16 and is operable to display various information corresponding to the device 10 or 10A, such as golf courses, maps, locations, and directions as described below. The display 18 may comprise conventional black and white, monochrome, or color display elements including, but not limited to, Liquid Crystal Display (LCD), Thin Film Transistor (TFT) LCD, Polymer Light Emitting Diode (PLED), Organic Light Emitting Diode (OLED) and/or plasma display devices. Preferably, the display 18 is of sufficient size to enable the user to easily view it while outdoors.

The display 18 may be integrated with the user interface 22, such as in embodiments where the display 18 is a touch-screen display to enable the user to interact with it by touching or pointing at display areas to provide information to the device 10.

The memory 20 may be integral with the location determining component 12, integral with the computing device 16, stand-alone memory, or a combination of both. The memory may include, for example, removable and non-removable memory elements such as RAM, ROM, Flash, magnetic, optical, USB memory devices, and/or other conventional memory elements.

The memory 20 may store various data associated with operation of the device 10 or 10A, such as the computer program and code segments mentioned above, or other data for instructing the computing device 16 and other device elements to perform the steps described herein. Further, the memory 20 may store various cartographic data corresponding to geographic locations including map data, and map elements, such as terrain, alert locations, points of interest, geographic entities, and other navigation data to facilitate the various navigation functions provided by the device. Additionally, the memory 20 may store destination addresses and previously calculated or otherwise acquired routes to various destination addresses for later retrieval by the computing device 16.

To implement functions and features of the present invention, the memory 20 or some other memory accessible by the computing device 16 may also store cartographic information for golf courses. For example, the memory 20 may store cartographic data showing the tee boxes, fairways, greens, hazards, etc. for selected golf courses or for all known golf courses. The cartographic information may be pre-loaded in the memory 20 or other memory or may be downloaded to the device 10 via the communication component 26 or I/O ports 28. For example, cartographic information for a particular golf course may be downloaded to the device 10 based on a current location of the device 10 as determined by the location determining component 12.

The various data stored within the memory 20 may be associated within one or more databases to facilitate retrieval of the information. For example, the databases may be configured to enable the computing device 16 to automatically access the cartographic information based upon a current geographic location of the device 10 as discussed in more detail below.

A map-matching search engine, preferably comprised of software, firmware or the like executed by the computing device 16, may search through the database of cartographic information to find known golf courses or golf course holes which match a series of geographical coordinates. A user may initiate a search or the search engine may automatically search the database based on a state of the device 10 or 10A such as the current position of the device. The search engine, or alternatively a separate computation engine (also preferably comprised of software, firmware or the like executed by the computing device 16), may also perform calculations related to the cartographic information. The map mapping search engine may also identify a map location, such as a golf course, golf course hole, golf course fairway, or golf course green associated with one or more geographical coordinates.

The user interface 22 permits a user to operate the device 10 or 10A and is generally associated with the housing 30 or 30A, such as by physical connection through wires, etc, or wirelessly utilizing various wireless protocols. However, the user interface 22 need not be physically coupled with the housing.

The user interface 22 may comprise one or more functionable inputs such as buttons, switches, scroll wheels, a touch screen associated with the display, voice recognition elements such as a microphone, pointing devices such as mice, touchpads, trackballs, styluses, a camera such as a digital or film still or video camera, combinations thereof, etc. Further, the user interface 22 may comprise wired or wireless data transfer elements such as removable memory including the memory 20, data transceivers, etc, to enable the user and other devices or parties to remotely interface with the device. The device may also include a speaker for providing audible instructions and feedback.

The user interface 22 may be operable to provide various information to the user utilizing the display 18 or other visual or audio elements such as a speaker. Thus, the user interface 22 enables the user and device to exchange information relating to the device 10, including geographic entities, configuration information, security information, preferences, route information, points of interests, alerts and alert notification, navigation information, waypoints, a destination address, etc.

The power source 24 provides electrical power to the location determining component 12, the sensor 14, the computing device 16, the display 18, the memory 20, the user interface 22, and the communications component 26. The power source 24 may comprise conventional power supply elements, such as batteries, battery packs, etc. The power source 24 may also comprise power conduits, connectors, and receptacles operable to receive batteries, battery connectors, or power cables. For example, the power source 24 may include both a battery to enable portable operation and a power input for receiving power from an external source such an automobile.

To preserve battery life, the satellite navigation receiver or other location-determining component 12 may be switched off periodically. For example, the receiver may be alternatively switched on for 30 seconds, off for two minutes, then back on for 30 seconds. If the location-determining component 12 determines the electronic device 10 is moving, it may be switched on more frequently.

The communications component 26 enables the device 10 or 10A to communicate with other electronic devices through a communication network, such as the Internet, a local area network, a wide area network, an ad hoc or peer to peer network, or a direct connection such as a USB, Firewire, or Bluetooth™ connection, etc. The communications component 26 may communicate utilizing wireless data transfer methods such as WiFi (802.11), Wi-Max, Bluetooth™, ANT®, ultra-wideband, infrared, cellular telephony, radio frequency, etc.

The communications component 26 may make and receive any communications including incoming and outgoing phone calls, text messages, instant message, voicemail messages, e-mail message, missed phone calls, and any other known communications.

In one embodiment, the communications component 26 is a cellular transceiver for transmitting and receiving communications over a cellular phone network such as those operated by Sprint®, AT&T®, Verizon®, and other companies. The cellular phone network may operate with GSM (Global System for Mobile communications), CDMA (Code Division Multiple Access), or any other known standards.

The device 10 or 10A may also include a Frequency Modulated (FM) receiver for receiving information such as music, Radio Data system (RDS) information, FM Traffic Message Channel (TMC) information, direct band information such as MSN Direct™ data, or the like. The communications component 26 may also permit communications over several different networks. For example, the device 10 may be operable to transmit and receive communications over a cellular network, a short-range FM radio network, and a WiFi network.

The I/O ports 28 permit data and other information to be transferred to and from the computing device 16 and the location determining component 12. The I/O ports 28 may include a Secure Digital (SD) card slot, Mini SD Card slot, Micro SD Card slot or the like for receiving removable SD cards, Mini SD Cards, Micro SD Cards, or the like, and a USB port for coupling with a USB cable connected to another computing device such as a personal computer. Navigational software, cartographic maps and other data and information may be loaded in the device 10 or 10A via the I/O ports 28 or the communications component 26.

The housing 30 of device 10 may be handheld or otherwise portable to facilitate easy transport of the device 10. The housing 30A of the device 10A may be configured for attachment to a golfer's arm or wrist, much like a watch. In either case, the housing is preferably constructed from a suitable lightweight and impact-resistant material such as, for example, plastic, nylon, aluminum, or any combination thereof and may include one or more appropriate gaskets or seals to make it substantially waterproof or resistant. The housing may take any suitable shape for size, and the particular size, weight and configuration of the housing may be changed without departing from the scope of the present invention.

The components shown in FIGS. 1-5 and described herein need not be physically connected to one another since wireless communication among the various depicted components is permissible and intended to fall within the scope of the present invention.

The above-described embodiments of the electronic device 10 or 10A may be used by a golfer or someone accompanying a golfer to sense the golfer's swing characteristics while striking a golf ball, determine ball flight data related to the actual landing location of the ball, associate data representative of the swing characteristics with the ball flight data, display representations of the swing characteristics and ball flight data, calculate golf-related statistics, and develop and display user profiles for golfers. These and other features and functions are described in more detail below.

A golfer, or someone accompanying the golfer such as a caddie, instructor, or playing partner, first uses the device 10 or 10A to determine an approximate start position of a golf ball 39 before it is struck. This can be done by carrying the device 10, or wearing the device 10A, in the vicinity of the golf ball and then pressing a button or other element of the user interface 22 to prompt the location determining component and computing device to store a current location of the device. Alternatively, the start position of the golf ball may be automatically captured when the device 10 senses that the golf ball 39 has been struck and/or when the device 10 senses that the golfer is swinging. For example, the device 10 may monitor when the golfer begins moving after remaining relatively stationary for a prescribed amount of time, as determined by the location determining component, and then mark this location as the start point of the golf ball. The device 10, using the sensor 14, may additionally or alternatively detect the force resulting from the impact of the golf ball against the club head. The position of the golf ball can also be determined with another device or method and then manually input into the device 10. The approximate start position of the golf ball is preferably identified by coordinate data such as longitude and latitude data.

Figure 3:
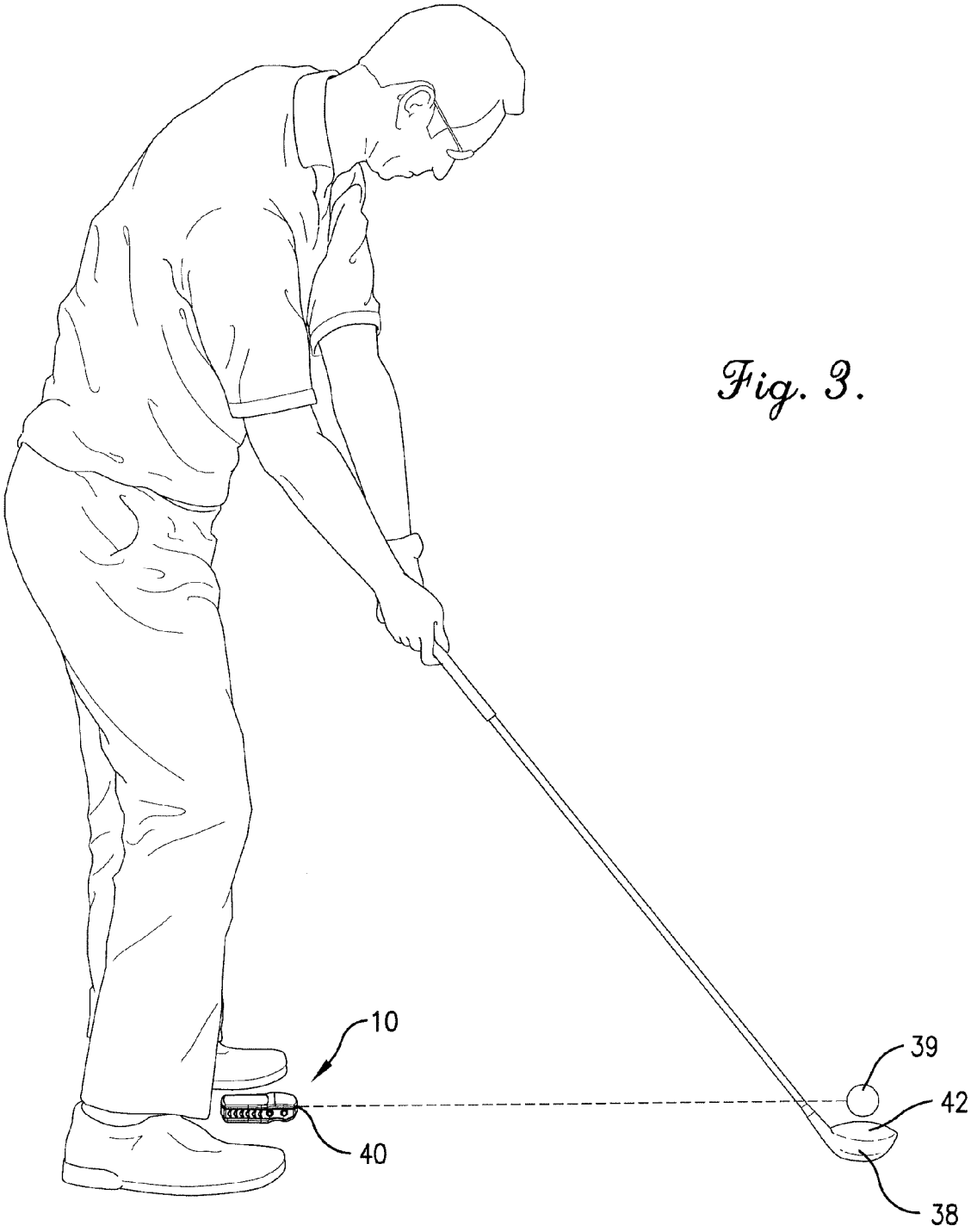
FIG. 3 is an isometric view of a golfer using the device of FIG. 1 in accordance with certain aspects of the invention.

The device 10 is then used to sense at least one swing characteristic of the golfer or the golfer's golf club 38 while the golfer strikes the ball. This can be done by placing the device 10 on the ground near the golf ball 39 as shown in FIG. 3 so that the radiation source 40 projects one or more planes of radiation in the vicinity of the golf ball. The golfer then swings the golf club 38, with the radiation sensor 42 attached thereto or embedded therein, through the radiation planes. The processing system associated with the sensor 14 then calculates a club head characteristics such as loft angle, face angle, velocity, and/or path based on when various parts of the club pass through the one or more radiation planes.

Additionally or alternatively, the device 10A may be used to sense a swing characteristic. A golfer first places the device on his or her wrist or other body part as shown in FIG. 4 and then strikes the golf ball 39 with the golf club 38. The inertial sensor in the device then measures accelerations of the golfer's arm or other body part to determine a motion parameter such as a duration of the golfer's backswing, down-swing, or follow-through or a speed or tempo of the golfer's swing or portion of a swing. Details of such an inertial sensor, and its use in determining golf swing characteristics, are disclosed in the above-referenced U.S. Patent Application Publication No. 2007/0208544.

In some embodiments, the device 10 and device 10A may be used together to sense swing characteristics. For example, the device 10 may be used to determine a golf club loft angle, face angle, or other characteristics and the device 10A may be used to determine the golfer's swing tempo or other speed or tempo characteristic. The device 10A may then transmit data representative of its sensed golf swing characteristic the device 10, or vice versa, where the data may be combined and/or stored together. The components of the device 10 and device 10A may also be combined in a single housing or other enclosure.

After the golfer has struck the golf ball 39, the device 10 or 10A is used to determine and store the approximate rest position of the ball. This may be done by carrying the device to the golf ball and again pressing a button or other element of the user interface to prompt the location determining component and the computing device to determine and store the current location of the ball. The approximate rest position of the ball may also be automatically determined when, for example, the device 10 or 10A senses that the golfer has stopped walking for a pre-determined amount of time and has therefore arrived at the rest position of the golf ball 39.

To simplify operation of the device 10 or 10A, the user interface 22 may include dedicated buttons for storing the position of the ball 39 before and after it is struck. For example, the user interface may have a first button labeled "Start Position," "Start," or something similar that can be pressed to record the start position of a golf ball and a second button labeled "Landing," "Rest Position," or something similar that can be pressed to record the landing or rest portion of the ball.

Once the device 10 or 10A is used to determine and record both the approximate start and rest positions of the golf ball 39, the computing device 16 calculates ball flight data based on these two positions. The ball flight data may also take into account other location data such as the boundaries of a fairway, the locations of sand traps, bodies of water and other hazards, the location of a green, etc. The ball flight data may be representative of any aspect of a golf shot, including, but not limited to a distance between the approximate start position and approximate rest position of the golf ball; an angle between the approximate start position and approximate rest position of the golf ball; a distance between the approximate rest position of the golf ball and a fairway; a distance between the approximate rest position of the golf ball and a green; a distance between the approximate rest position of the golf ball and a portion of a green; a distance between the approximate rest position of the golf ball and a flagstick; or a distance between the approximate rest position of the golf ball and a hazard.

After the ball flight data and swing characteristic data is captured as described above, the computing device 16 associates the ball flight data with the swing characteristic data. The ball flight data and swing characteristic data may be associated in many different ways, including, but not limited to, storing or otherwise linking the data together in memory; displaying the data together on the display; encoding the ball flight data with a meta tag or other representation of the associated swing characteristic data; encoding the swing characteristic data with a meta tag or other representation of the ball flight data; or any other known method of associating data.

In one exemplary embodiment, the computing device 16 associates the swing characteristic data with the ball flight data by storing both sets of data in a database, table, or other memory structure. FIG. 7 illustrates an exemplary database 700 for associating swing characteristic data with ball flight data. The first column 702 of database 700 indicates a shot or swing number; the second column 704 indicates a sensed swing characteristic for each of the shots or swings; and the third column 706 indicates ball flight data for each of the shots or swings. For example, the first line in database 700 indicates that the golfer had an open clubface on his or her first swing that resulted in a shot that traveled 210 yards and 10 degrees right of a desired path (e.g. center of fairway). Database 700 is merely an example of how the computing device may associate swing characteristic data with actual ball flight data. The particular data, and the arrangement and presentation of the data in the database 700 may be modified, supplemented, or otherwise altered without departing from the scope of the claims.

The computing device 16 may also associate a particular golf club, or type of golf club, with the swing characteristic data and the ball flight data. An identification of a type of golf club may be manually input or otherwise selected by the golfer or other user of the device. Alternatively, the computing device may automatically sense the type of golf club by reading an identifier on or in the golf club. For example, each golf club may be equipped with an RFID tag or similar device that identifies the golf club and any characterizing information. An RFID reader contained in the electronic device 10 or 10A may then read the RFID tag for a club once it is removed from the golfer's golf bag or otherwise placed in the vicinity of the device.

FIG. 8 shows an exemplary database 800, table, or other memory structure for associating a golf club type with swing characteristic data and ball flight data. As with the database 700, the first column 802 of database 800 indicates shot or swing numbers. The second column 804 indicates the golf club, or type of golf club, used for each of the shots. The third column 806 indicates a sensed swing characteristic for each of the shots. The fourth column 808 indicates ball flight data for each of the shots. The ball flight data may include the distance and direction of a shot as shown in column 706 of database 700 or may be an indication of whether the shot was a slice, hook, or other commonly described type of shot as shown in column 808 of database 800. For example, the first line of database 800 indicates that the golfer used a driver for his first shot, swung with an open clubface, and hit a slice. Database 800 is merely an example of how the computing device may associate swing characteristic data, ball flight data, and golf club types. The particular data, and the arrangement and presentation of the data in the database 800 may be modified, supplemented, or otherwise altered without departing from the scope of the claims.

The computing device 16 may also accumulate swing characteristic data and ball flight data for a plurality of golf swings and then create a user profile for a golfer. FIG. 9 shows an exemplary database 900, table, or other memory structure showing such a user profile. The first column 902 of database 900 indicates representative swing characteristics exhibited by the golfer, the second column 904 indicates the frequency of each of the swing characteristics, and the third column 906 lists the cumulative results of the shots. For example, the first line of database 900 indicates the golfer swung with an open clubface 14 times, resulting in 10 slices and 2 hooks. The database 900 may also include a field or line 910 identifying the golfer and a field or line 912 indicating the date or date range for the golf swings represented in the database. The database 900 of FIG. 9 is merely one example of a user profile. The particular data, and the arrangement and presentation of the data in the database 900 may be modified, supplemented, or otherwise altered without departing from the scope of the claims.

The computing device 16 may also calculate, store, and display statistical information based on the swing characteristic data and ball flight data. For example, the computing device may calculate statistical information such as the average distance and trajectory for every golf club used by a golfer.

FIG. 10 shows an exemplary database 1000, table, or other memory structure for storing statistical information. The first column 1002 lists all the golf clubs used by a golfer or just those sensed by the device as discussed above. The second column 1004 lists the frequency each of the clubs was used during a statistical time period. The third column 1006 lists the average driving or hitting distance for each of the golf clubs, and the fourth column 1008 lists the average path, trajectory, or other directional aspect for each of the golf clubs. For example, the first line of database 1000 indicates that the golfer used his or her driver 872 times during a particular statistical time period, drove the ball an average of 242 yards, and on average landed the ball 27 yards right of a fairway centerline or other desired path. Database 1000 may also include a field or line 1010 identifying the golfer and a field or line 1012 indicating the date or date range for the golf swings. Database 1000 merely shows exemplary statistical information. The particular data, and the arrangement and presentation of the data in database 1000 may be modified, supplemented, or otherwise altered without departing from the scope of the claims.

In other embodiments, the device 10 or 10A may associate the ball flight data with the swing characteristic data by displaying representations of the data alongside one another. For example, the computing device 16 may display a representation of the ball flight data and a representation of the swing characteristic data superimposed or otherwise displayed on a cartographic map of a particular golf hole or golf course. A user may then scroll over or otherwise select the representations of either the ball flight data or the swing characteristic data to retrieve and display some of the data.

Figure 11:
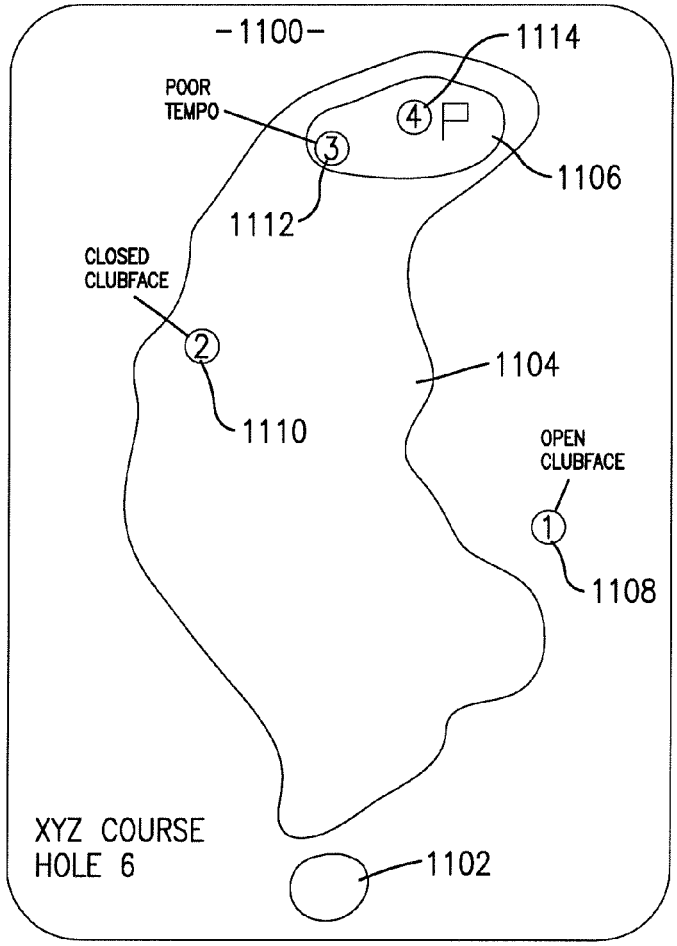
FIG. 11 is another sample screen display of the electronic device of FIG. 1 or FIG. 2 or of an external computing device.

FIG. 11 illustrates an exemplary map page 1100 with representations of ball flight data and swing characteristic data. The map page 1100 may show representations of a tee box 1102, a fairway 1104, a green 1106, as well as representations of the ball flight data for each golf shot made by a golfer while playing the hole. For example, a marker 1108 may indicate the golfer's first shot, a marker 1110 may indicate the golfer's second shot, a marker 1112 may indicate the golfer's third shot, and a marker 1114 may indicate the golfer's fourth and final shot. The markers 1108-1114 may be numbers representing the corresponding shot numbers or may be any other symbol, character, or identifier.

The markers 1108-1114 may be linked or otherwise associated with the ball flight data and swing characteristic data stored in the device 10 or 10A so that a user may scroll over or otherwise select any of the markers 1102-1108 to obtain and display swing characteristic data for the associated shots. For example, if the golfer scrolls over the marker 1108, the computing device 10 may access the swing characteristic data associated with the first shot and display "Open Clubface" or some other description alongside the marker 1108. Alternatively, the swing characteristic data may always be displayed alongside the markers 1108-1114 so that the golfer can immediately view information about his or her swing for all shots without scrolling over the markers. Map 1100 is merely an example of how the computing device may display representations of swing characteristic data with ball flight data. The particular data, and the arrangement and presentation of the data in the map 1100 may be modified, supplemented, or otherwise altered without departing from the scope of the claims.

Figure 12:
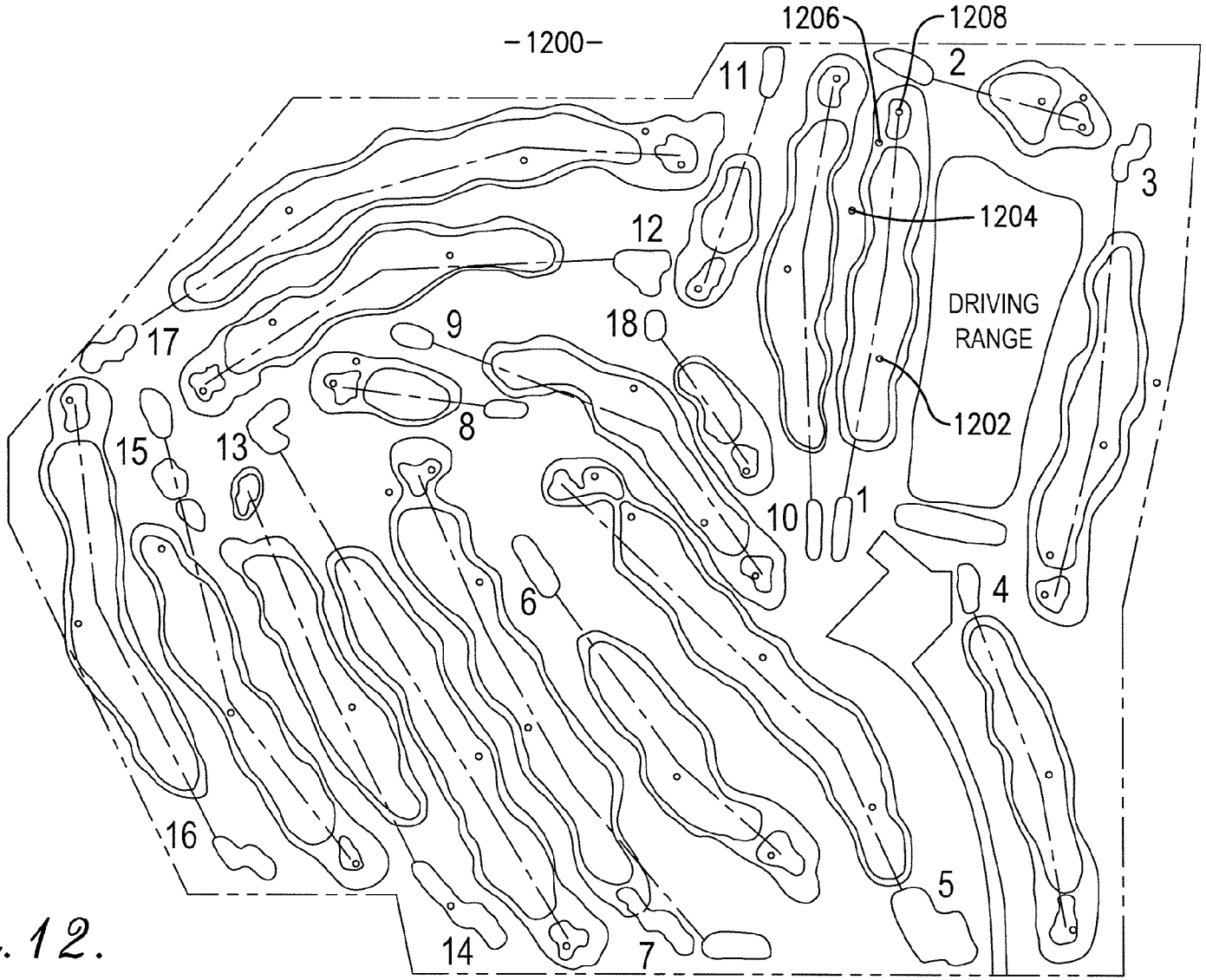
FIG. 12 is another sample screen display of the electronic device of FIG. 1 or FIG. 2 or of an external computing device.

The device may also associate swing characteristic data and ball flight data for all 18 holes of a golf course. The swing characteristic data and ball flight data may then be superimposed or otherwise displayed over a cartographic map of a golf course. FIG. 12 shows an exemplary map 1200 with each of the golfer's shots indicated by a marker such as the markers 1202, 1204, 1206, and 1208. The golfer can scroll over any of the markers and obtain more information about the shot as mentioned above. For example, if the golfer scrolls over the marker 1202, the computing device may display an overlay showing that the shot was made with a driver, traveled approximately 200 yards, and was approximately 5 yards from the center of the green or other desired path. The computing device may also display some of the swing characteristic data. For example, if a golfer scrolls over the marker 1202, the computing device may indicate "Poor Tempo" or other swing characteristic.

Databases 700, 800, 900, or 1000, maps 1100 or 1200, or any other similar presentations of the swing characteristic data and ball flight data may be displayed on the device 10 or 10A or may be downloaded or otherwise transferred to an external personal computer, laptop computer, personal digital assistant, or any other external device. The swing characteristic data and ball flight data may also be transmitted to a server-type computer operated by a golf country club or other entity and stored along with handicap or other scoring data for the golfer.

Figure 13:
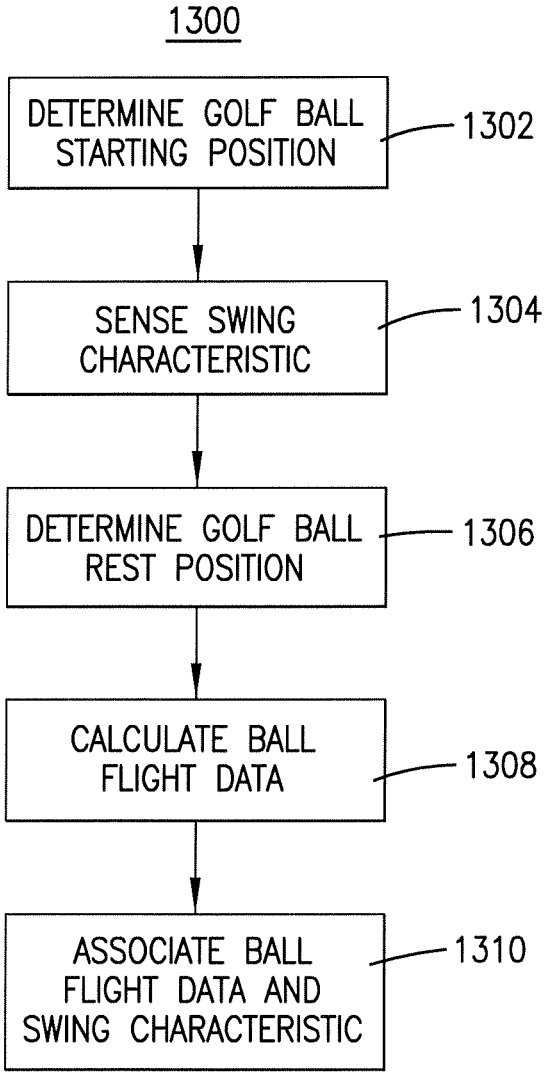
FIG. 13 is a flow diagram illustrating selected steps in an exemplary method of the present invention.

FIG. 13 illustrates certain steps in an exemplary method 1300 of using the electronic device 10 or 10A. The particular order of the steps illustrated in FIG. 13 and described herein can be altered without departing from the scope of the invention. For example, some of the illustrated steps may be reversed, combined, or even removed entirely.

In step 1302, the location-determining component 12 determines the approximate location of a golf ball before it is struck. As mentioned above, a user may trigger the device to obtain and store the start location by standing next to the golf ball and pressing a button or other element on the user interface 22. Alternatively, the approximate start location may be automatically detected or the user may obtain the start location from another source and manually enter it into the device.

In step 1304, the device 10, 10A, or both, sense a swing characteristic as the golfer strikes the golf ball. The swing characteristic may be sensed with a motion-type sensor, an inertial-type sensor, or any other type of sensor. Swing characteristic data for the sensed swing characteristic is then stored in the memory or other memory.

In step 1306, the location-determining component 12 determines the approximate landing or rest location of the golf ball after it has been struck. As mentioned above, a user may trigger the device to obtain and store the approximate rest position of the golf ball by standing next to the golf ball and pressing a button or other element on the user interface 22. Alternatively, the approximate rest position may be automatically detected or the user may obtain the rest position of the golf ball from another source and manually enter it into the device.

In step 1308, the computing device calculates ball flight data based on the approximate start position and approximate rest position of the golf ball. The ball flight data may include a distance between the approximate start position and approximate rest position of the golf ball; an angle between the approximate start position and approximate rest position of the golf ball; a distance between the approximate rest position of the golf ball and a fairway; a distance between the approximate rest position of the golf ball and a green; a distance between the approximate rest position of the golf ball and a portion of a green; a distance between the approximate rest position of the golf ball and a flagstick; or a distance between the approximate rest position of the golf ball and a hazard.

In step 1310, the computing device associates the ball flight data and swing characteristic data by storing the data together in a database or other memory structure, displaying the data together, or by linking the data in any other way. The golfer or other user may then view or otherwise access the data together to assess how certain swing characteristics affect golf shots.

Figure 14:
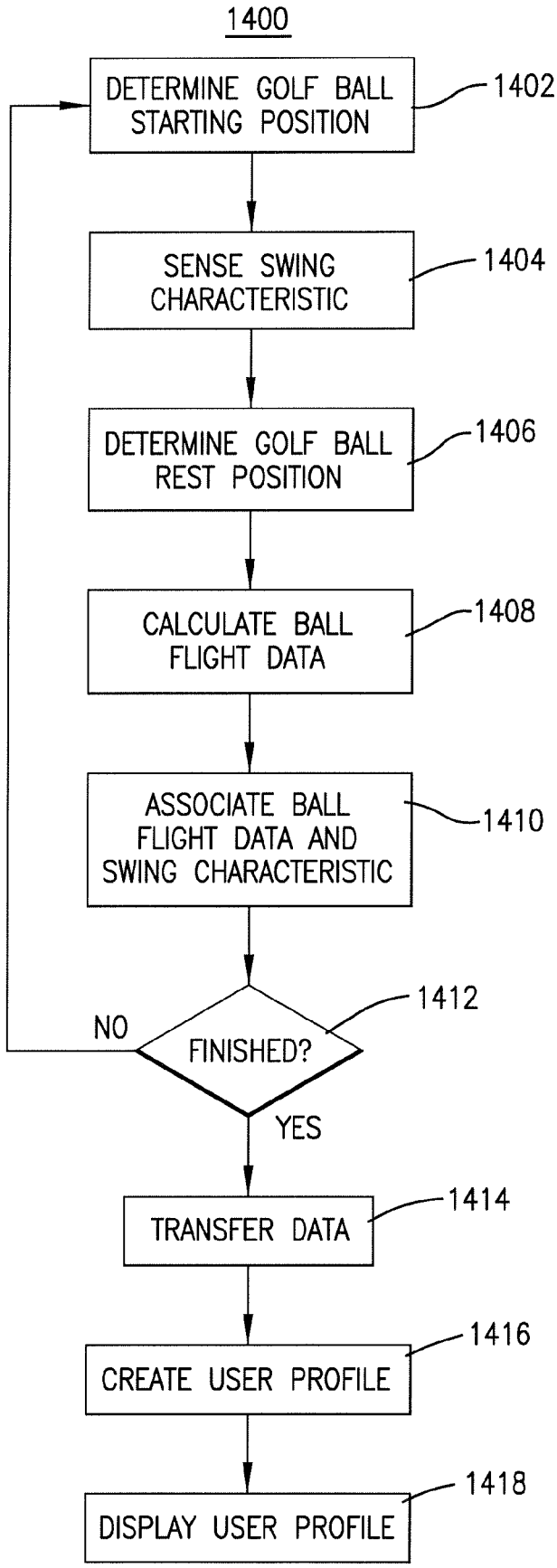
FIG. 14 is a flow diagram illustrating selected steps in another exemplary method of the present invention.

FIG. 14 illustrates certain steps in another exemplary method 1400 of using the electronic device 10 or 10A. As with the method 1300 illustrated in FIG. 13, the particular order of the steps illustrated in FIG. 14 and described herein can be altered without departing from the scope of the invention.

Steps 1402, 1404, 1406, 1408, and 1410 are essentially identical to steps 1302, 1304, 1306, 1308, and 1310, respectively. In step 1412, the computing device determines whether the golfer has finished practicing, playing, or otherwise striking golf balls. If the answer to step 1412 is "no," the method returns to step 1402 and repeats steps 1402 through 1412 until the answer to step 1412 is "yes."

In step 1414, the computing device transfers the swing characteristic data and ball flight data obtained in steps 1402 through 1412 to an external computer. Step 1416 then creates a user profile such as the ones illustrated in FIGS. 9 and 10 for all of the shots made by the golfer. The user profile and other associated information, including score, can be provided through the communications network to a service such as Garmin® Connect® to share profiles, course information, and scores with other users.

Step 1418 then displays the user profile and may superimpose the swing characteristic data and ball flight data over cartographic data as shown in FIGS. 11 and 12.

Although embodiments of the invention have been described with reference to the attached drawing figures, it is noted that equivalents may be employed and substitutions made herein without departing from the scope of the invention as recited in the claims. For example, embodiments of the device 10 or 10A may also include a heart rate sensor, a clock, a thermostat, or any other sensor to measure and associate the golfer's heart rate, the time of day, the temperature, or any other measurable parameter, respectively, with the swing characteristic data and/or the ball flight data.

Having thus described the preferred embodiment of the invention, what is claimed as new and desired to be protected by Letters Patent includes the following:

The invention claimed is:

1. A method for analyzing golf swings, the method comprising the steps of:

(a) determining with a location-determining component an approximate start position of a golf ball;

(b) sensing with a sensor at least one swing characteristic as a golfer strikes the golf ball, the sensor including an inertial sensor worn or carried by the golfer;

(c) determining with the location-determining component an approximate rest position of the golf ball after it has been struck by the golfer;

(d) calculating ball flight data based on the approximate start position and the approximate rest position of the golf ball; and (e) associating the ball flight data with data representative of the swing characteristic sensed by the inertial sensor.

2. The method as set forth in claim 1, wherein the associating step further comprises the steps of:

repeating steps (a)-(e) for a plurality of golf swings made by the golfer;

analyzing the swing characteristics and the ball flight data for at least some of the golf swings; and creating a user profile for the golfer based on the analyzing step.

3. The method as set forth in claim 2, wherein the user profile includes data corresponding to a frequency of certain swing characteristics and data corresponding to a frequency of certain ball flight data.

4. The method as set forth in claim 2, wherein the user profile includes data which predicts future golf swing results based on the swing characteristic data and the ball flight data.

5. The method as set forth in claim 1, wherein the associating step includes the step of linking in memory data representative of the swing characteristic and data representative of the ball flight data.

6. The method as set forth in claim 1, wherein the swing characteristic includes a club head loft angle, a club head face angle, a club head velocity, a club swing path, a club swing plane, a stance of the golfer, a head position of the golfer, a backswing of the golfer, an impact position of the golfer, a follow-through of the golfer, a shoulder rotation of the golfer, or a wrist angle of the golfer.

7. The method as set forth in claim 1, wherein the ball flight data is representative of: a distance between the approximate start position and approximate rest position of the golf ball; an angle between the approximate start position and approximate rest position of the golf ball; a distance between the approximate rest position of the golf ball and a fairway; a distance between the approximate rest position of the golf ball and a center of a fairway; a distance between the approximate rest position of the golf ball and a green; a distance between the approximate rest position of the golf ball and a portion of a green; a distance between the approximate rest position of the golf ball and a flagstick; or a distance between the approximate rest position of the golf ball and a hazard.

8. The method as set forth in claim 1, further including the step of associating a type of golf club used to strike the ball with the swing characteristic data and the ball flight data.

9. The method as set forth in claim 1, wherein the location-determining component is a satellite navigation receiver.

10. The method as set forth in claim 1, wherein the associating step includes the step of displaying a representation of the ball flight data and the swing characteristic data on a display.

11. The method as set forth in claim 1, wherein (a) includes detecting impact of the golf ball using the sensor and automatically determining the start position using the location determining component in response to the detected impact.

12. A device for analyzing golf swings, the device comprising:

a location determining component for determining an approximate start position of a golf ball and an approximate rest position of the golf ball after it has been struck by a golfer;

a sensor for sensing at least one swing characteristic as the golfer strikes the golf ball, the sensor including an inertial sensor worn or carried by the golfer; and a computing device coupled with the location determining component and the sensor for calculating ball flight data based on the approximate start position and the approximate rest position of the golf ball and for associating the ball flight data with data representative of the swing characteristic sensed by the inertial sensor.

13. The device as set forth in claim 12, wherein the location determining component includes a satellite navigation receiver for receiving navigation signals from a plurality of satellites and for determining the approximate start and rest positions of the golf ball as a function of the received signals.

14. The device as set forth in claim 12, wherein the sensor includes a radiation source for projecting radiation in at least one plane in the vicinity of the golf ball before it has been struck and a receiver carried by a golf club for detecting or reflecting the radiation as the golf club passes through the plane.

15. The device as set forth in claim 12, wherein the computing device is further operable to create a user profile for the golfer based on the ball flight data and swing characteristic data for a plurality of golf swings.

16. The device as set forth in claim 12, wherein the computing device associates the ball flight data and swing characteristic data by linking the data in memory.

17. The device as set forth in claim 12, wherein the swing characteristic includes a club head loft angle, a club head face angle, a club head velocity, a club swing path, a club swing plane, a stance of the golfer, a head position of the golfer, a backswing of the golfer, an impact position of the golfer, a follow-through of the golfer, a shoulder rotation of the golfer, or a wrist angle of the golfer.

18. The device as set forth in claim 12, wherein the ball flight data is representative of: a distance between the approximate start position and approximate rest position of the golf ball; an angle between the approximate start position and approximate rest position of the golf ball; a distance between the approximate rest position of the golf ball and a fairway; a distance between the approximate rest position of the golf ball and a center of a fairway; a distance between the approximate rest position of the golf ball and a green; a distance between the approximate rest position of the golf ball and a portion of a green; a distance between the approximate rest position of the golf ball and a flagstick; or a distance between the approximate rest position of the golf ball and a hazard.

19. The device as set forth in claim 12, further including a display coupled with the computing device for displaying a representation of the ball flight data and the swing characteristic data.

20. The device as set forth in claim 12, wherein the sensor is further operable to detect impact of the golf ball and the location determining component is operable to automatically determine the start position in response to the detected impact.

21. A device for analyzing golf swings, the device comprising:

a satellite navigation receiver for determining an approximate start position of a golf ball and an approximate rest position of the golf ball after it has been struck by a golfer;

a sensor for sensing at least one swing characteristic as the golfer strikes the golf ball, the sensor including an inertial sensor worn or carried by the golfer;

a display;

a memory;

a computing device coupled with the satellite navigation receiver, the sensor, the display, and the memory for calculating ball flight data based on the approximate start position and the approximate rest position of the golf ball, for associating the ball flight data with data representative of the swing characteristic sensed by the inertial sensor, for storing the ball flight data and the swing characteristic data in the memory, and for displaying a representation of the ball flight data and the swing characteristic data on the display; and a portable housing for housing the satellite navigation receiver, the sensor, the display, the memory, and the computing device.

22. The device as set forth in claim 21, wherein the sensor includes a radiation source for projecting radiation in at least one plane in the vicinity of the golf ball before it has been struck and a receiver carried by a golf club for detecting or reflecting the radiation as the golf club passes through the plane.

23. The device as set forth in claim 21, wherein the sensor is further operable to detect impact of the golf ball and the satellite navigation receiver is operable to automatically determine the start position in response to the detected impact.

* * * * *